US006974531B2

(12) United States Patent
Andricacos et al.

(10) Patent No.: US 6,974,531 B2
(45) Date of Patent: Dec. 13, 2005

(54) METHOD FOR ELECTROPLATING ON RESISTIVE SUBSTRATES

(75) Inventors: Panayotis Andricacos, Croton on Hudson, NY (US); Hariklia Deligianni, Tenafly, NJ (US); Wilma Jean Horkans, Ossining, NY (US); Keith T. Kwietniak, Highlandfalls, NY (US); Michael Lane, Cortlandt Manor, NY (US); Sandra G. Malhotra, Beacon, NY (US); Fenton Read McFeely, Ossining, NY (US); Conal Murray, Yorktown Heights, NY (US); Kenneth P. Rodbell, Sandy Hook, CT (US); Philippe M. Vereecken, Sleepy Hollow, NY (US)

(73) Assignee: International Business Machines Corporation, Armonk, NY (US)

( * ) Notice: Subject to any disclaimer, the term of this patent is extended or adjusted under 35 U.S.C. 154(b) by 130 days.

(21) Appl. No.: 10/269,956

(22) Filed: Oct. 15, 2002

(65) Prior Publication Data

US 2004/0069648 A1 Apr. 15, 2004

(51) Int. Cl.[7] ..... C25D 5/18; B32B 15/00

(52) U.S. Cl. ..... 205/102; 205/104; 205/157; 205/261; 205/291; 205/640; 428/615; 428/620; 428/655; 428/656; 428/674; 428/926

(58) Field of Search ..... 205/102, 104, 205/157, 261, 291, 640; 428/615, 620, 655, 656, 674, 926

(56) References Cited

U.S. PATENT DOCUMENTS

| | | | | | |
|---|---|---|---|---|---|
| 5,968,333 | A | * | 10/1999 | Nogami et al. | 205/184 |
| 6,160,315 | A | * | 12/2000 | Chiang et al. | 257/762 |
| 6,309,969 | B1 | * | 10/2001 | Oskam et al. | 205/291 |
| 6,451,448 | B1 | * | 9/2002 | Kanda et al. | 428/612 |
| 6,534,116 | B2 | * | 3/2003 | Basol | 427/97 |
| 2002/0104761 | A1 | * | 8/2002 | Birss et al. | 205/102 |
| 2003/0057097 | A1 | * | 3/2003 | Tsai et al. | 205/102 |

* cited by examiner

*Primary Examiner*—Robert R. Koehler
(74) *Attorney, Agent, or Firm*—Connolly, Bove, Lodge & Hutz, LLP; Robert M. Trepp

(57) ABSTRACT

A conductive material is electroplated onto a platable resistive metal barrier layer(s) employing a plating bath optionally comprising a super filling additive and a suppressor, and by changing the current or voltage as a function of the area of plated metal. A structure is also provided that comprises a substrate, a platable metal barrier layer(s) located on the substrate and a relatively continuous uniform electroplated layer of a conductive material located on the platable resistive metal barrier layer.

23 Claims, 6 Drawing Sheets

(5 of 6 Drawing Sheet(s) Filed in Color)

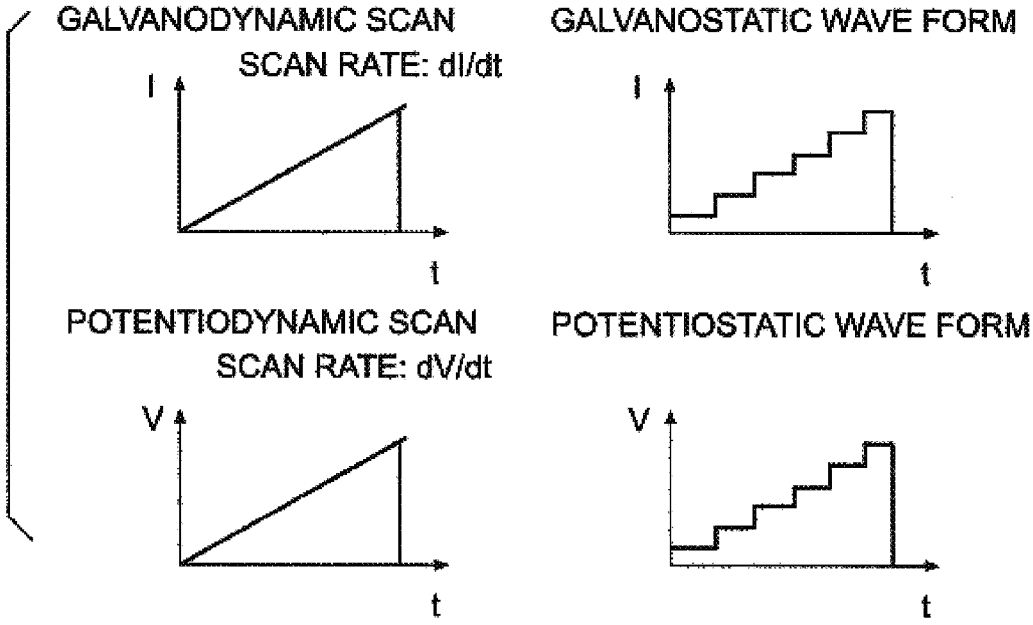
FIG. 3(a)
FIG. 3(b)
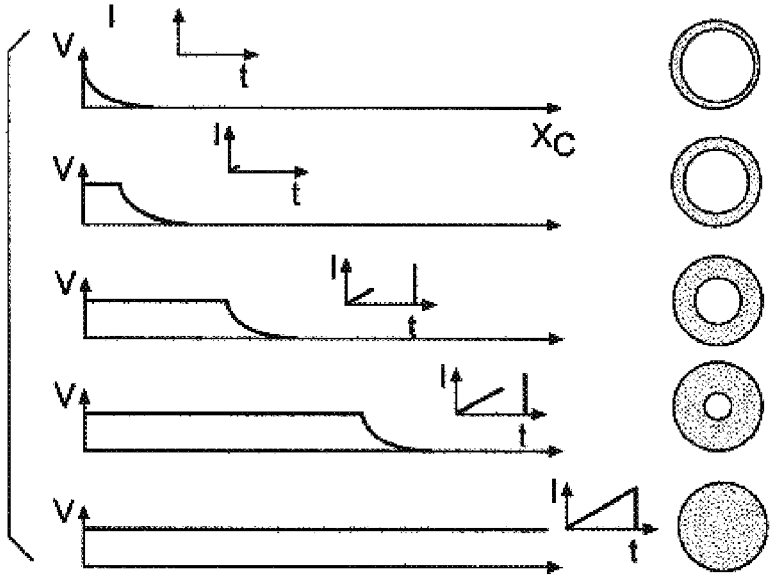
FIG. 3(c)
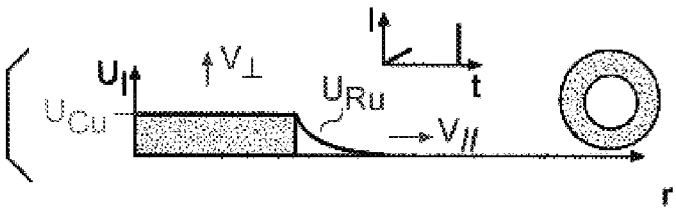

METHOD FOR ELECTROPLATING ON RESISTIVE SUBSTRATES

TECHNICAL FIELD

The present invention relates to electroplating an electrically conductive material such as a relatively low resistive metal and especially copper onto a platable resistive metal barrier layer or stack of layers. More particularly, the present invention relates to directly plating onto the resistive metal without the need of a seed or catalyst layer, and especially without the need of a copper seed layer (even though a thin seed may be present, e.g. about 1 Å–about 600 Å). The present invention makes it possible to form a continuous and relatively uniform layer by growing a thin film from the edge of the surface to be plated towards its center by controlling the conditions of the current or voltage being applied.

BACKGROUND OF INVENTION

The current damascene plating process and especially that for copper requires a copper seed as a conductive layer on top of the highly resistive barrier liner which covers the underlying substrate such as a patterned wafer. The continuous miniaturization of ULSI technology will eventually require the elimination of this copper seed layer. Without this conductive seed, an applied current or voltage will drop off drastically within a short distance from the edge where the electrical contact is made (as will be described below.) As a result of this so-called terminal effect, a sufficient overpotential, $\eta$, for copper deposition will only exist near the edge of the substrate and plating is observed at the edge of the substrate only. When applied current is based on the total area of the substrate the effective current density for the perimeter ring is much higher and as a result burned, powdery deposits are obtained.

Conventional methods to overcome the terminal effects for thin seed layers such as low plating current, segmented anode configuration, high copper concentration and low conductivity (low acid concentration) copper plating baths improve the current distribution and result in a more uniform film thickness. However, these methods apply only in the case where a sufficient plating overpotential exists over the whole substrate surface, from edge to center. For very thin seed layers and more importantly in the absence of a seed layer, the terminal effect of the resistive liner or seed causes such a drastic increase in the potential of the liner material, $U_m(r)$, from the edge ($r=r_0$) to center ($r=0$) of the wafer, that the overpotential, $\eta$, becomes zero at a certain distance from the electrical contact and no further plating can occur:

$$\eta=U_{eq,Cu^{2+}/Cu}-U_m(r) \quad (1)$$

with $U_{eq,Cu^{2+}/Cu}$ the equilibrium potential (Nernst potential) for copper deposition.

Copper deposition will proceed when $\eta>0$, i.e. when $U_m(r)<U_{eq,Cu^{2+}/Cu}$, as illustrated schematically in the energy diagram for a metal/electrolyte interface shown in FIG. 1. FIG. 2*a* shows the variation of the plating overpotential in the case of a thin copper seed and FIG. 2*b* in the case of the highly resistive liner material on extremely thin copper seeds. For the 60 nanometer copper seed, the sheet resistance is still low enough to ensure deposition over the whole substrate surface, although with a non-uniform growth rate in the case of a primary current distribution. The drop-off in the overpotential is much more severe for the highly resistive liner, and becomes zero at a certain distance, $x=r_0-r$, from the edge of the wafer. In this case deposition is only observed at the edge of the wafer. Additionally, too low current or overpotential results in a low density of nucleation sites leading to powdery, poorly adherent deposits. Although the example of copper deposition on liners is used above to facilitate an understanding of this invention, the principle of seedless plating holds for the deposition of any conductive material (metal, compound, alloy, composite, semi-metal or semiconductor) onto a resistive substrate.

SUMMARY OF INVENTION

The present invention addresses above discussed problems of prior electroplating and particularly makes it possible to achieve a relatively uniform and continuous layer of a conductive material such as a metal onto a highly resistive metal barrier layer or liner without requiring a seed or catalyst layer. The present invention also applies to the case of highly resistive thin seed layers (e.g. up to about 60 nanometers).

One aspect of the present invention relates to electroplating a conductive material such as a metal directly onto a resistive metal barrier layer(s) or liner(s) located on a substrate such as a patterned layer. The method comprises contacting the substrate with a plating bath that optionally can comprise a super filling additive and a suppressor and applying a changing current or voltage across electrodes. The substrate acts as one electrode (working electrode) and a conductive material that acts as a second electrode (inert or sacrificial counter electrode, which may be segmented).

The current or voltage is changed during plating resulting in an average current increase from an initially small or zero current to a final current corresponding to the desired current density for the total plated area.

Another aspect of the present invention relates to a plated structure obtained by the above-disclosed electroplating method.

A still further aspect of the present invention relates to a structure comprising a substrate, a relatively high resistive metal barrier layer and optionally a highly resistive seed layer located on the substrate and relatively continuous, relatively uniform electroplated layer about 10 nanometers to about 100 micrometers thick of a metal directly located on the relatively high resistive metal liner or barrier layer in the absence of a seed layer or with a very thin seed layer of about 1 to about 60 nanometers thick.

Other objections and advantages of the present invention will become readily apparent to those skilled in this art from the following detailed description, wherein it is shown and described only the preferred embodiments of the invention, simply by way of illustration of the best mode contemplated of carrying out the invention. As will be realized, the invention is capable of other and different embodiments, and its several details are capable of modifications in various obvious respects, without departing from the invention. Accordingly, the description is to be regarded as illustrative in nature and not as restrictive.

SUMMARY OF DRAWINGS

The patent or application filed contains at least one drawing executed in color. Copies of this patent or patent application publication with color drawings will be provided by the Office upon request and payment of the necessary fee.

FIG. 3*a* is a schematic presentation of increasing the current or voltage according to the present invention.

FIG. 3*b* is a schematic representation of the progressive growing of copper from the edge to the center with the associated distribution of the electrode potential for the plated copper film (no potential drop assumed) and of the resistive liner material.

FIG. 3*c* is a schematic representation of the directions of the perpendicular growth vi, and the progressive growth rate, vii for the directly plated film.

FIG. 5*a* illustrates a linear current ramp technique for plating on a rectangular substrate with electrical contact at only one edge according to the present invention taking into account the change in the plated area.

FIG. 5*b* illustrates a technique for current change according to the present invention taking into account the change in plating area for a circular wafer with a terminal ring contact.

FIG. 5*c* is the same as FIG. 5*b* with discrete current steps superimposed on the current program.

BEST AND VARIOUS MODES FOR CARRYING OUT INVENTION

According to the present invention, a conductive material such as a metal is directly electroplated onto a resistive metal barrier layer to provide a substantially continuous and substantially uniform layer. The advantages of the present invention are achieved by controlling the current or potential for the electroplating and the types of plating baths used.

The parameter of the present invention of controlling the applied current or potential comprising increasing the current or voltage with time to first form a perimeter layer of plated metal (compound, alloy, semi-metal or semiconductor); whereas, increasing the current or voltage is on the average as a function of the plated area to thereby grow the plated area towards the center of said substrate to form a substantially continuous and substantially uniform layer.

The current is changed from an initially small or zero value to a final, higher value corresponding to a certain current density for the total plated area through a current program comprising a series of current steps (positive and/or negative), a linear current ramp, a nonlinear current ramp or a combination thereof.

Alternatively the voltage is changed from an initial small value corresponding to an open-circuit potential or a small overpotential to a final larger voltage corresponding to a large overpotential for deposition through a voltage program comprising a series of voltage steps, a linear voltage ramp, a nonlinear voltage ramp or any combination thereof.

Figure 5:
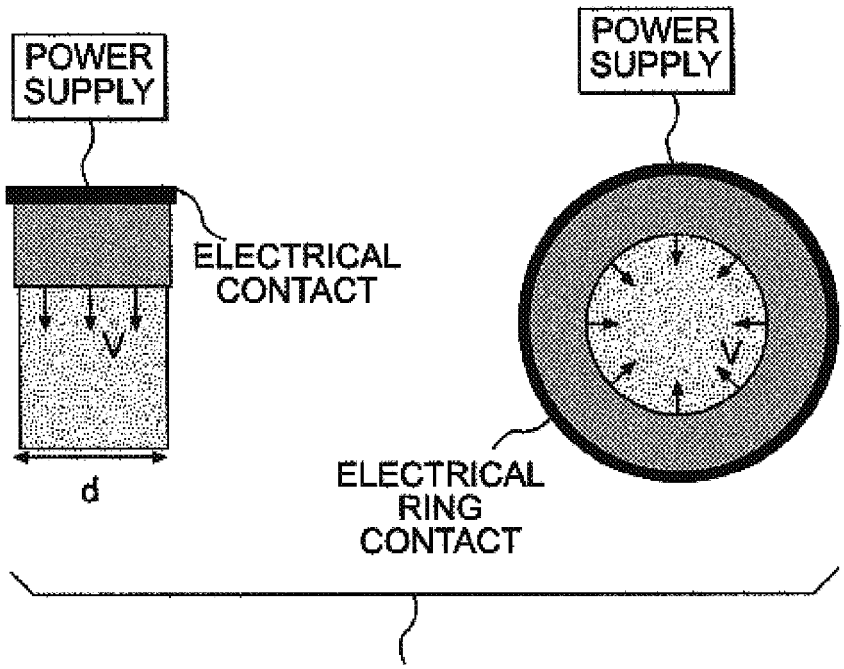
FIGS. 5*a*–5*c* show several possible current programs according to the present invention.

The principle of the current or potential program employed this invention is illustrated schematically in FIG. 3. Some examples of current programs are shown in FIG. 5.

Figure 5A:
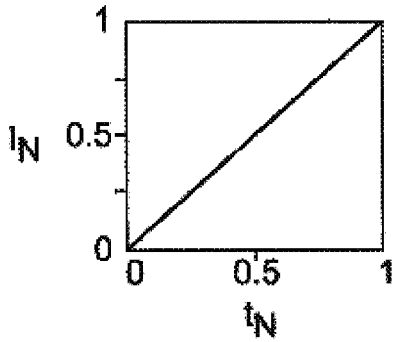
Figure 5B:
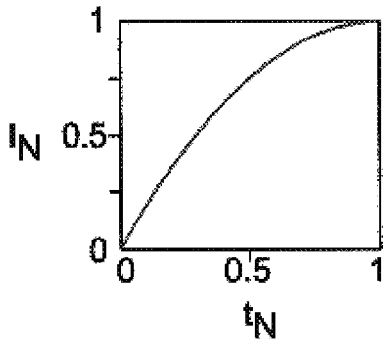
Figure 5C:
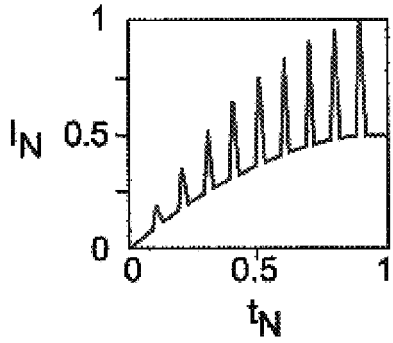

Since the surface coverage changes during the applied current or voltage program, the effective current density during plating is determined by the total plated area at that point in time. Under ideal circumstances the current program is such that the effective current density approaches the desired current densities necessary for plating a particular structure (also the desired current densities may change over time during plating, for example an additional applied nucleation pulse as illustrated in FIG. 5*c*).

The targeted current densities can cover a very broad range (10 $\mu$A/cm$^2$–2 A/cm$^2$), depending on the application, the plating process, the plated material and the metal ion concentration in the plating bath. For example, the current density used for the gap fill step during damascene copper plating typically is between 0.1 mA/cm$^2$ and 15 mA/cm$^2$. The range for the effective current density during deviates from the targeted current density at most about 100%, preferably at most about 25% and most preferably substantially constant (about a 10% deviation).

Because of the severe terminal effect an overpotential for deposition only exists at a certain distance from the electrical contact, and plating will occur only on that area of the substrate.

As an explanation of the drastic drop off of an appeared current or voltage within a short distance from the edge where the electrical contact is made, the following theoretical analysis is presented. In particular, the potential distribution for a thin resistive metal film such as a liner material is described by the Poison equation for ohm's law:

$$\nabla^2 U_m(r) = -R_s i_m(\eta) \tag{2}$$

with $U_m(r)$, the potential of the metal film at a radius r from the center of distance $x=r_0-r$ from the electrical contact or terminal at the edge, $R_s$, the sheet resistance of the film and $i_m$, the current density in the film which depends on the overpotential η. The minus sign in equation (2) indicates that the resistance and thus the potential increases with increasing distance, x, from the electrical contact or terminal, or hence decreases with radius r. A ring contact is usually used as an electrical contact for wafer plating and it may be assumed that the potential variation for a wafer is mainly a function of the radius, r, from the edge to center and that the angular variation is negligible. Equation (2) then reduces to its one-dimensional form:

$$\frac{1}{r}\frac{d}{dr}\left(r\frac{dU_m(r)}{dr}\right) = \frac{d^2U_m(r)}{dr^2} + \frac{1}{r}\frac{dU_m(r)}{dr} = R_s i_m(\eta) \tag{3}$$

with boundary conditions $$U_m(r) = U_{m,edge} \text{ for } r = r_0 (x = 0) \text{ and } \frac{dU_m(r)}{dr} = 0 \text{ for } r = 0 (x = r_0) \tag{4}$$

with $r_0$, the radius of the wafer. For a constant current density $i_m$, the differential equation (3) yields the quadratic solution:

$$U_m(r) = U_{m,edge} - \frac{1}{4} R_s i_m (r^2 - r_0^2) \tag{5}$$

showing an increase of the potential for the resistive film from edge to center. From equation (1) it then follows that the overpotential η decreases from the edge towards the center of the wafer accordingly. Due to nucleation, adsorption or inhibition processes the effective overpotential for plating is usually more negative than the theoretical difference given in equation (1). The effective overpotential for copper deposition, $\eta_{eff}$, is defined by:

$$\eta_{eff} = U_{eq,Cu^{2+}/Cu} - U_m(r) - \Delta\eta \tag{6}$$

with $U_{eq,Cu^{2+}/Cu}$ the Nernst equilibrium potential for copper deposition and Δη the contribution of a nucleation overpotential or an adsorption/inhibition overpotential and is determined by the experimental value for the onset potential, $U_{onset}$ for copper deposition through:

$$\Delta\eta = U_{eq,Cu^{2+}/Cu} - U_{onset} \tag{7}$$

From equations (5) and (6) it follows that the effective overpotential for copper deposition is dependent on the distance, r from the wafer edge:

$$\eta_{eff} = \left(U_{eq,Cu^{2+}/Cu} - U_{m,edge} - \Delta\eta\right) + \frac{1}{4} R_s i_m (r^2 - r_0^2). \tag{8}$$

Although using the simplified case for a constant current, equation (8) shows that the overpotential for copper deposition will become zero at a certain distance from the edge. When a ring of copper is already plated around the edge of the wafer, the potential at the edge or terminal is now equal to the potential of the plated copper, $U_{m,edge} = U_{cu}$. In this case the effective overpotential is given by (taking into account equation (7)):

$$\eta_{eff} = (U_{onset} - U_{Cu}) + \frac{1}{4} R_s i_m (r^2 - r_0^2) \tag{9}$$

With $U_{onset}$ the onset potential of copper deposition at the resistive liner. From equation (9) the radius $r_{\eta=0}$ at which the overpotential becomes zero is given by:

$$r_{\eta=0} = \sqrt{r_0^2 - \frac{4(U_{onset} - U_{Cu})}{R_s i_{appl}}} \tag{10}$$

Both $U_{onset}$ and $U_{cu}$ for a certain applied current density can be determined experimentally. For direct plating on a W/Ru liner for example: $U_{onset}$=0.0 V (SCE) and $U_{cu}$=−0.2V (SCE), $R_s$=15 Ω and $i_{appl}$=5 mA/cm$^2$, a value for $r_{\eta-0}$ of 9.5 cm is calculated for a 200 mm wafer. Hence for a resistive W/Ru liner an overpotential for plating exists only up to a distance x=0.5 cm from the edge only. Also from equation (10) it can be estimated for a wafer with a copper seed that under the same conditions the plating overpotential will reach zero at a certain distance from the center when the Cu seed is less than 10 nm thick. Equations (9) and (10) also show that the effective overpotential depends on the wafer size. For a 300 mm wafer, the distance from the edge where a plating overpotential exists decreases to 0.4 cm in the case of the W/Ru liner, and now a copper seed thicker than 25 nm is necessary for an overpotential to exist over the whole wafer surface. Note that to derive equation (10), a constant current density over the whole wafer surface was assumed.

When the variation of $i_m$ with overpotential η is known (which again can be determined experimentally) the variation of η with r can be plotted directly from the general solution of equation (3). If the case is considered in which $i_m$ varies linearly with overpotential η:

$$i_m(\eta) = \left(\frac{i_o}{\eta_o}\right)\eta \tag{11}$$

Then the governing differential equation for the overpotential has the following form:

$$\frac{d^2\eta^{(r)}}{dr^2} + \frac{1}{r}\frac{d\eta(r)}{dr} - \left(\frac{R_S i_o}{\eta_o}\right)\eta(r) = 0 \tag{12}$$

with boundary conditions $$\eta(r_o) = \eta_{edge} \text{ and } \frac{d\eta(0)}{dr} = 0 \tag{13}$$

Figure 1A:
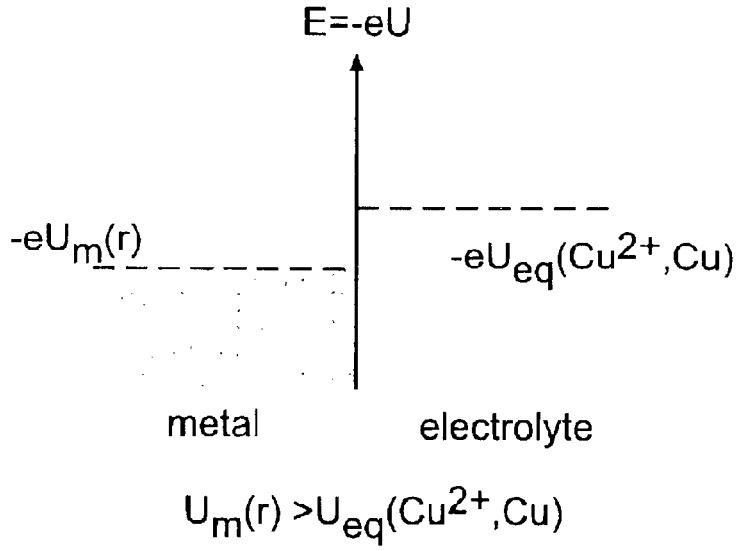
FIGS. 1*a* and 1*b* represents energy diagrams of a metal/electrolyte interface for situations of no plating (1*a*) and plating (1*b*).
Figure 1B:
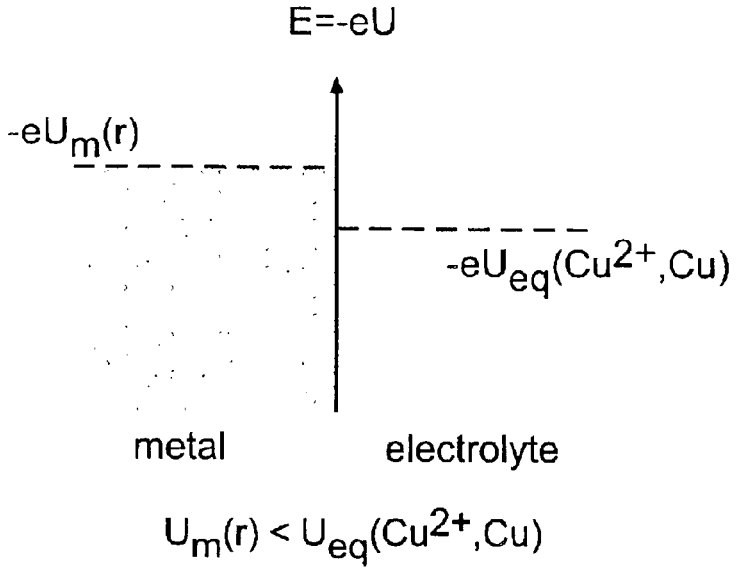
Figure 2A:
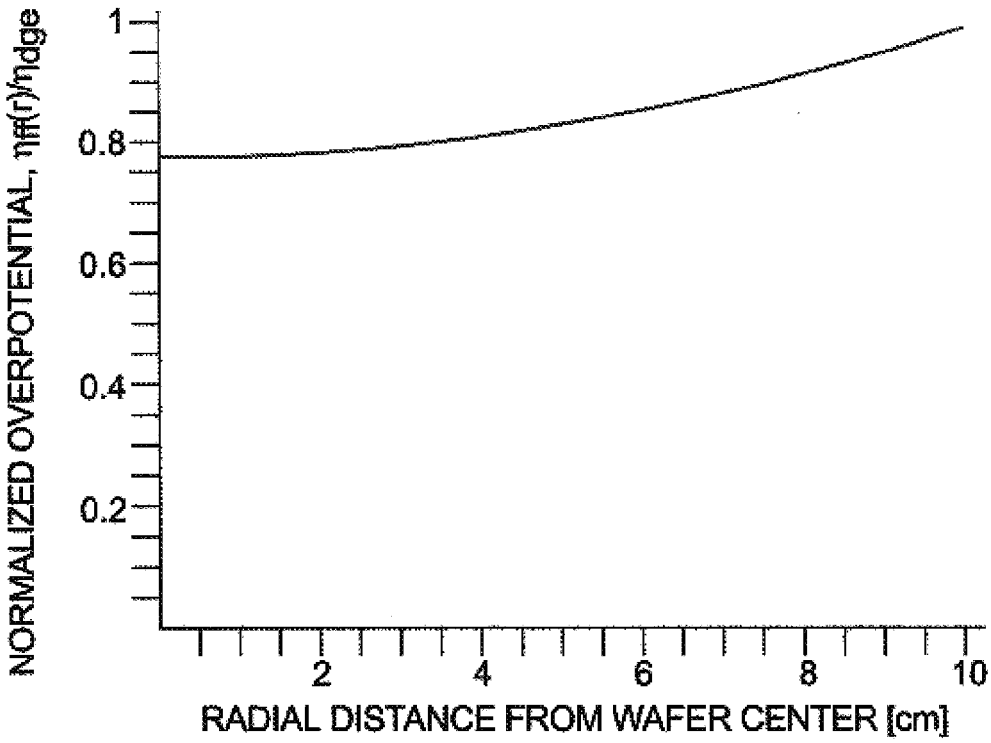
FIG. 2*a* shows the variation of the plating overpotential for a relatively thick copper seed (60 nm).
Figure 2B:
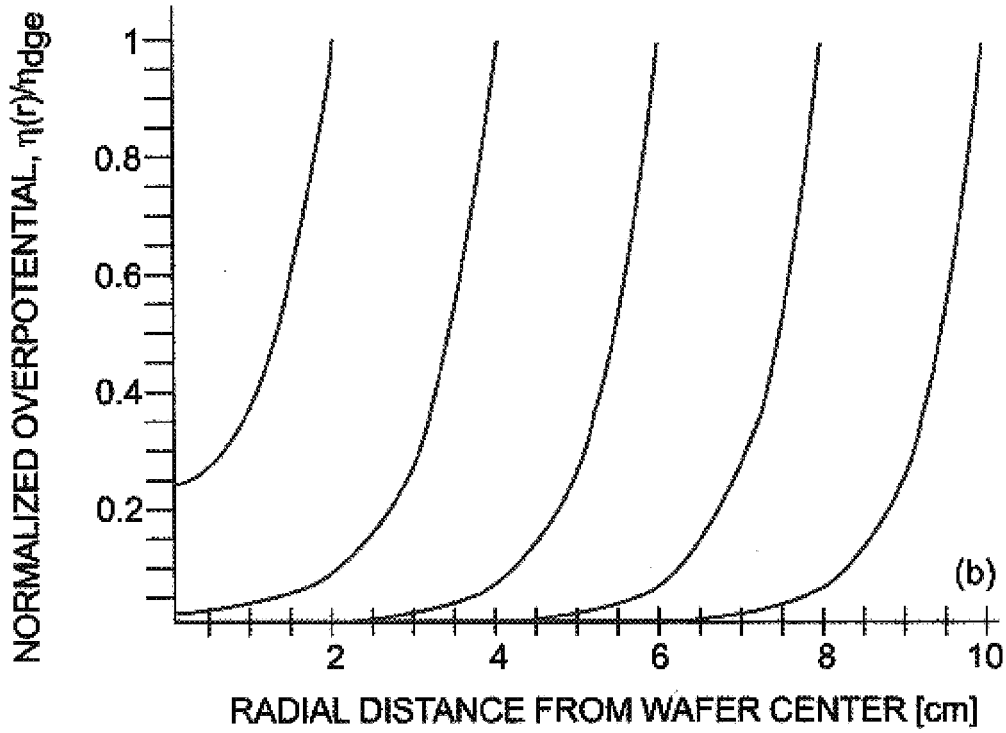
FIG. 2*b* shows the variation of the plating overpotential for a highly resistive liner material or highly resistive seed (sheet resistance of 15 Ω).

The solution for the overpotential has the following form:

$$\eta(r) = \eta_{edge} \frac{I_o\left(r\sqrt{\frac{R_{sio}}{\eta_o}}\right)}{I_o\left(r_o\sqrt{\frac{R_{sio}}{\eta_o}}\right)} \tag{14}$$

where $$I_o\left(r\sqrt{\frac{R_{sio}}{\eta_o}}\right)$$

represents the modified zero order Bessel function. FIG. 2 shows the variation of the overpotential normalized to $U_{m,edge} = U_{cu}$ with wafer radius for a relatively conductive copper seed layer and a resistive liner material with the ring terminal positioned at different positions on the wafer (i.e. the inwards growing copper ring during plating). The current density was assumed to vary linearly with overpotential; i.e. from the onset potential of deposition on the liner to the potential of the plated copper edge. The value for the current density at the liner was estimated from the current voltage curve.

The above is merely a theoretical analysis used to help explain the effectiveness of the present invention. Accordingly, the inventors are not to be bound by it.

The applied current needed for copper deposition is proportional to the desired current density and the effective area and hence is initially small. The copper plated in this initial region now acts as a conductive layer and the position of the electrical contact is virtually shifted away from the edge of the substrate, towards the center of the wafer. The terminal effect has shifted along and the drop of the copper overpotential from $U_{cu}$ (which is the electrode potential at the copper) to zero is now observed at a distance away from the edge (see FIG. 2*b*). By applying an incremental or continuous increase of the current over time, the effective current density is kept constant or at least within a certain range at the desired current density for via and trench fill and for bright copper deposits. In this way the copper front and the terminal effect moves progressively over the wafer surface towards the center and eventually the whole wafer will be covered by a conductive copper layer. Once the plated copper seed reaches the center of the wafer, the copper can be plated up with conventional methods to the desired film thickness.

Several possible current or voltage programs can be applied (see FIGS. 3 and 5, and the disclosure hereinabove): discrete current (voltage), linear and non linear changing currents (voltages) and combinations thereof.

Figure 4A:
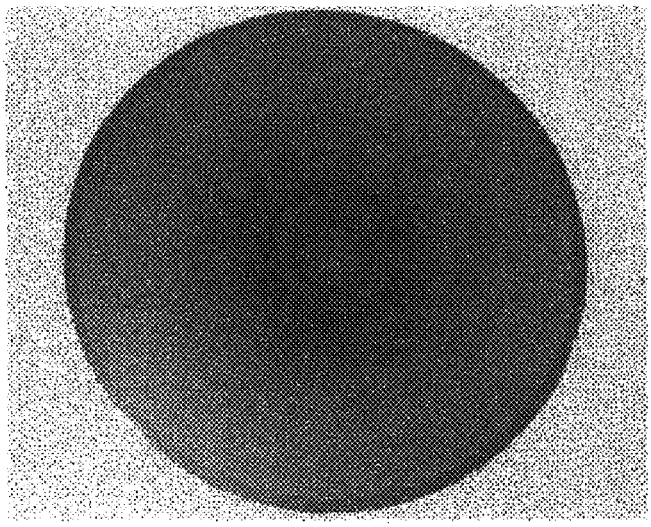
FIG. 4*a* shows a photograph of directly plated copper on a 200 mm wafer illustrating the ring structure morphology obtained when not too small a number of current steps are applied.
Figure 4B:
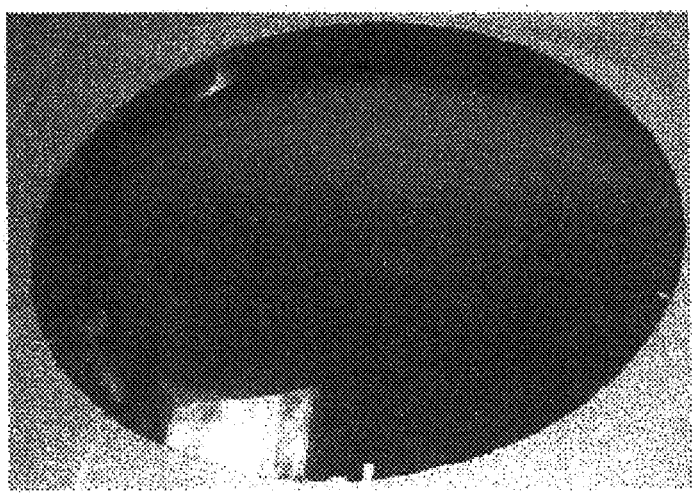
FIG. 4*b* shows a photograph of directly plated copper on a 200 mm wafer according to the present invention showing a continuous, uniform and shiny copper layer when a linear current ramp is used.
Figure 4C:
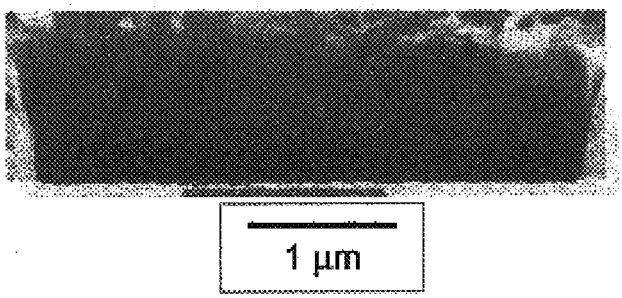

In the case of discrete steps, for each applied current (voltage) step, the copper front will move inwards with time and hence increase the effective area for deposition. As a result, the current density will decrease with time and when the time is long, the current density will eventually become too small to provide sufficient nucleation on the liner material. As a result dull deposits are obtained at the far edge of the deposit. Hence, when the number of applied current steps is too small (the step time too long) copper rings will be observed. An example of a plated ring structure is shown in FIG. 4*a*. To obtain a continuous (ring free) deposit, it is important to keep the effective current density within a certain range. This can be achieved by using a short time (up to about 1 second) or alternatively by using a continuous changing current (voltage). An example of a continuous, bright copper deposit formed under these conditions is shown in FIG. 4*b*. More importantly, to obtain void-free fill of high aspect ratio vias and trenches only a small variation (up to about 50%) in the current density is preferred. In summary, to obtain good fill of features and uniform continuous bright copper films, the number of current steps has to be large and in the ideal case a continuous increase of the current with time is applied. In the most simple case a linear current ramp is applied (see FIG. 3). However, to accommodate for the exact change in plated surface area the current ramp may also be a more complex non-linear function of time.

The change in surface area with time depends on the geometric shape of the substrate. For a rectangular strip with width, d, the change of the effective area, $A_{eff}$ is constant with time $dA_{eff}/dt=dv$, assuming a constant progression rate of the copper front, $v=dx/dt$, with x, the distance from the edge (see FIG. 5*a*). In this case a linear current ramp applies. In the case of a circular wafer using a ring contact at the edge, the change in effective area of the plated ring decreases linearly with time, $dA_{eff}/dt=2\pi(r_c v-v^2 t)$, and in this case a more complex quadratic current-time program is necessary to maintain a constant current density (see FIG. 5*b*).

Additional current spikes can be superimposed on the applied current-time program for example to provide an additional nucleation step in the case where otherwise poor adhesion with the substrate is observed (see FIG. 5*c*). In general, a wide range of current techniques can be designed for seedless plating, as long as the global result is an increase from an initial low current to a final higher current density to accommodate the change in effective surface area due to a progressing plated region from the edge where electrical contact is made towards the other end of the substrate to assure full coverage or coverage up until a certain point. Alternatively a change in potential technique can be used, driving the potential towards a larger plating overpotential with time.

The current density employed is typically about 10 $\mu A/cm^2$ to about 2 $A/cm^2$, more typically about 0.1 $mA/cm^2$ to about 100 $mA/cm^2$ and preferably about 1 $mA/cm^2$ to about 20 $mA/cm^2$. The voltage depends on the tool configuration. The voltage employed is typically about 0 to about 20 volts, more typically about 0 to about 10 volts and preferably about 0 to about 5 volts.

With respect to the electroplating bath employed, during seedless plating with a progressive plated front as discussed in the previous section, there are basically two growth rates of interest: the progressive growth rate, $v_{\parallel}$ (parallel with the wafer surface), i.e. the rate at which the plated deposit progresses from the edge of the wafer where electrical contact is made towards the center of the wafer (or towards the other end of the substrate when electrical contact is made only at one end), and the growth rate of the plated deposit, $v\perp$ (perpendicular to the wafer surface). In order to have a deposit with uniform thickness, the progressive growth rate has to be much faster than the perpendicular growth rate of the plated film (see FIG. 3*c*); i.e. the effective plating overpotential has to be larger at the resistive substrate than at the plated film. This can be achieved by adding a suppressor additive to the plating bath which adsorbs strongly on the plated material and not or only weakly on the substrate. As a result, plating will be inhibited on the conductive plated deposit but not on the unplated or bare resistive substrate. Common copper plating baths used in surface finishing, electronic circuit board and microelectronics industry contain several organic and inorganic additives such as a suppressor, also known as a carrier, an accelerator, also know as a brightener and sometimes a leveling agent. At ppm levels these additives give rise to the so-called high throwing power (surface finishing industry) or superfilling (microelectronics). These chemistries show a net suppression or inhibition of copper deposition on copper and therefore can also be used for seedless plating. The compatibility of both processes allows direct combination of the seedless plating with supperfilling or high throwing power plating applications using the same bath solution.

Copper plating from solutions incorporating additives used to produce level deposits on a rough surface can be used to accomplish superfilling preferred to fill sub micron cavities. Some additives commercially available are available from Shipley Company, Marlboro, Mass. under the trade designations C-2001 for a carrier, B-2001 for a brightener, A-2001 for an accelerator, S-2001 for a suppressor and L-2001 for a leveler. A suitable system of additives is the one marketed by Enthone-OMI, Inc., of New Haven, Conn. and is known as the Via Form system. Another suitable system of additives is the one marketed by LeaRonal, Inc., of Freeport, N.Y., and is known as the Copper Gleam 2001 system. The additives are referred to by the manufacturer as Copper Gleam 2001 Carrier, Copper Gleam 2001-HTL, and Copper Gleam 2001 Leveller. And another suitable system of additives is the one marketed by Atotech USA, Inc., of State Park, Pa., and is known as the Cupracid HS system. The additives in this system are referred to by the manufacturer as Cupracid Brightener and Cupracid HS Basic Leveller.

Examples of specific additives which may be added to a bath in the instant invention are described in several patents. U.S. Pat. No. 4,110,176, which issued on Aug. 29, 1978, to H-G Creutz deceased et al., entitled l'Electrodeposition of Copper" described the use of additives to a plating bath such as poly alkanol quaternary-ammonium salt which formed as a reaction product to give bright, highly ductile, low stress and good leveling copper deposits from an aqueous acidic copper plating bath which patent is incorporated herein by reference. U.S. Pat. No. 4,376,685, which issued on Mar. 15, 1983, to A. Watson, entitled "Acid Copper Electroplating Baths Containing Brightening and Leveling Additives," described additives to a plating bath such as alkylated polyalkyleneimine which formed as a reaction product to provide bright and leveled copper electrodeposits from an aqueous acidic bath which patent is incorporated herein by reference. U.S. Pat. No. 4,975,159, which issued on Dec. 4, 1990, to W. Dahms, entitled "Aqueous Acidic Bath for Electrochemical Deposition of a Shiny and Tear-free Copper Coating and Method of Using Same," described adding to an aqueous acidic bath combinations of organic additives including at least one substituted alkoxylated lactam as an amide-group-containing compound in an amount to optimize the brightness and ductility of the deposited copper, which patent is incorporated herein by reference.

In U.S. Pat. No. 4,975,159, Table I lists a number of alkoxylated lactams which may be added to a bath in the instant invention. Table II lists a number of sulfur-containing compounds with water-solubilizing groups such as 3 mercaptopropane-1-sulfonic acid which may be added to a bath in the instant invention. Table III lists organic compounds such as polyethylene glycol which may be added to a bath as surfactants in the instant invention.

U.S. Pat. No. 3,770,598, which issued on Nov. 6, 1973, to H-G Creutz, entitled "Electrodeposition of Copper from Acid Baths," describes baths for obtaining ductile, lustrous copper containing therein dissolved a brightening amount of the reaction product of polyethylene imine and an alkylating agent to produce a quaternary nitrogen, organic sulfides carrying at least one sulfonic group, and a polyether compound such as polypropylene glycol, which patent is incorporated herein by reference.

U.S. Pat. No. 3,328,273, which issued on Jun. 27, 1967, to H-G Creutz et al., entitled "Electrodeposition of Copper from Acidic Baths," describes copper sulfate and fluoborate baths for obtaining bright, low-stress deposits with good leveling properties that contain organic sulfide compounds of the formula XR1—(Sn)—R2—SO3H, where R1 and R2 are the same or different and are polymethylene groups or alkyne groups containing 1–6 carbon atoms, X is hydrogen or a sulfonic group, and n is an integer of S 2-S inclusive, which patent is incorporated herein by reference. Additionally these baths may contain polyether compounds, organic sulfides with vicinal sulphur atoms, and phenazine dyes. In U.S. Pat. No. 3,328,273, Table I lists a number of polysulfide compounds which may be added to a bath in the instant invention. Table II lists a number of polyethers which may be added to a bath in the instant invention.

Additives may be added to the bath for accomplishing various objectives. The bath may include a copper salt and a mineral acid. Additives may be included for inducing in the conductor specific film microstructures including large grain size relative to film thickness or randomly oriented grains. Also, additives may be added to the bath for incorporating in the conductor material molecular fragments containing atoms selected from the group consisting of C, O, N, S and Cl whereby the electromigration resistance is enhanced over pure Cu. Furthermore, additives may be added to the bath for inducing in the conductor specific film microstructures including large grain size relative to film thickness or randomly oriented grains, whereby the electromigration behavior is enhanced over non electroplated Cu.

Similar superfilling results are obtained from a solution containing cupric sulfate in the rate from 0.1 to 0.4 M, sulfuric acid in the range from 10 to 20% by volume, chloride in the range from 10 to 300 ppm, and LeaRonal additives Copper Gleam 2001 Carrier in the range from 0.1 to 1% by volume, Copper Gleam 2001 HTL in the range from 0.1 to 1% by volume, and Copper Gleam 2001 Leveller in the range 0 to 1% by volume. Finally, similar superfilling results are obtained from a solution containing cupric sulfate, sulfuric acid, and chloride in the ranges mentioned above and Atotech additives Cupracid Brightener in the range from 0.5 to 3% by volume and Cupracid HS Basic Leveller in the range from 0.01 to 0.5% by volume.

The plating processes described thus far with additives produce superfilling of submicron, high-aspect-ratio features or cavities when performed in conventional plating cells, such as paddle plating cells described in U.S. Pat. Nos. 5,516,412, 5,312,532, which issued on May 17, 1994 to P. Andricacos et al., and U.S. Pat. No. 3,652,442. However, a further benefit described below is realized when the process is performed in a plating cell in which the substrate surface is held in contact only with the free surface of the electrolyte, for example a cup plating cell described in U.S. Pat. No. 4,339,319, which issued Jul. 13, 1982, to S. Aigo, which is incorporated herein by reference. The benefit here is the superfilling of wide cavities in the range from 1 to 100 microns, which may be present among the narrow (submicron) features or cavities.

In a plating cell in which the substrate is submerged in the electrolyte, wide features in the range from 1 to 100 microns will fill more slowly than do narrow features having a width less than 1 micron, such as about 0.1 and above; hence wide features necessitate both a longer plating time and a longer polishing time to produce a planarized structure with no dimples or depressions on the top plated surface.

In contrast in a cup plating cell, when the substrate surface to be plated is held in contact with the meniscus of the electrolyte during plating, cavities of greatly different widths such as less than 1 micron and greater than 10 microns are filled rapidly and evenly at the same rate.

The meniscus of the electrolyte is the curved upper surface of a column of liquid. The curved upper surface may be convex such as from capillarity or due to liquid flow such as from an upwelling liquid.

Figure 6A:
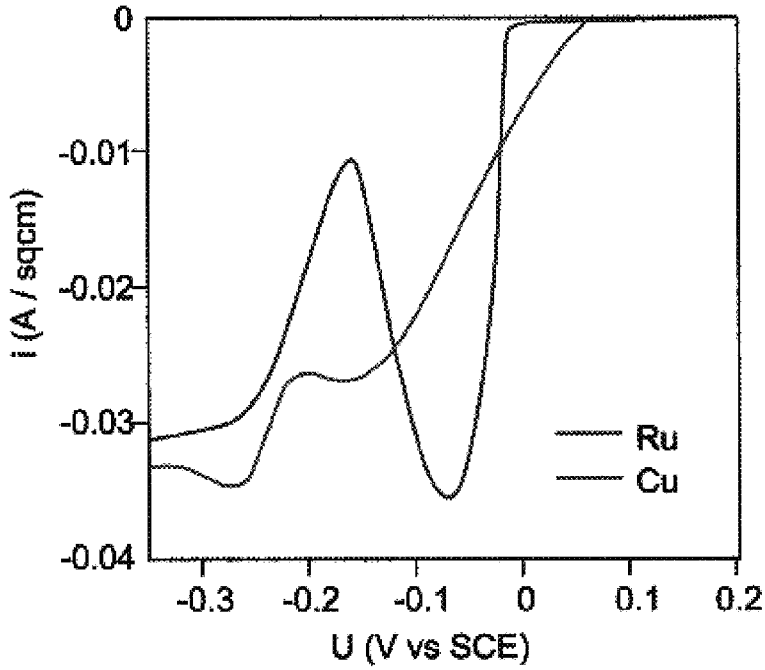
FIGS. 6*a* and 6*b* are current-voltage curves for ruthenium and copper from solutions without additives and with additives, respectively.
Figure 6B:
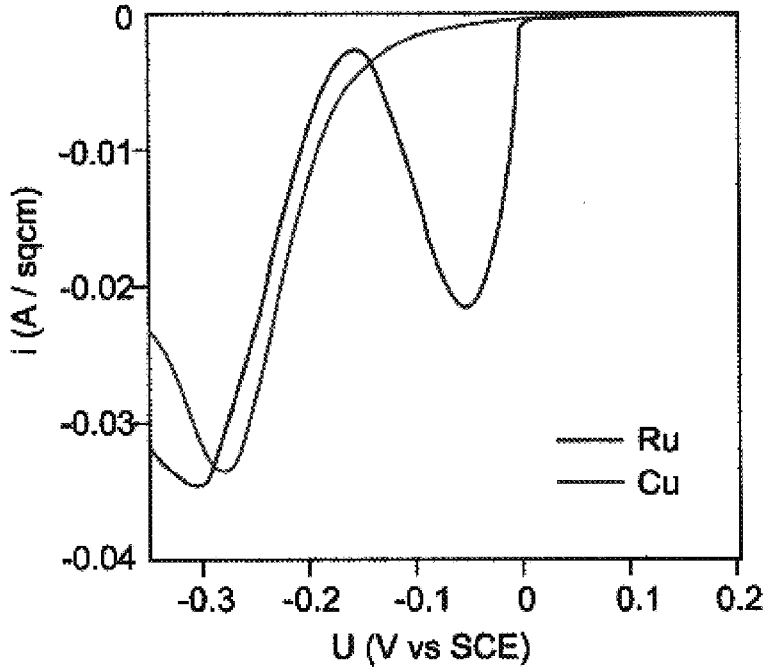

FIG. 6 shows current-voltage curves measured at copper and ruthenium surfaces in a acid copper sulfate solution without additives (FIG. 6*a*) and in a commercial copper plating solution which contains accelerator, suppressor and leveler additives (FIG. 6*b*). In the solution without additives copper deposition occurs at similar potentials for Ru and Cu. Eventhough a sharper deposition peak is observed for a Ru surface (due to nucleation and growth of copper nuclei), the onset of copper deposition is actually about 75 mV more positive at Cu than at Ru, i.e. for a certain applied potential, the effective plating overpotential will be larger at copper than at a ruthenium surface. Hence, in a solution without additives, plating of copper on copper is favored. Addition of the additives results in a drastic shift of the deposition onset potential for the Cu surface, whereas the onset potential for copper deposition on Ru remains unchanged. From FIG. 6 it is clear that copper plating is favored on a ruthenium surface in the solution with additives. Once copper nuclei are formed on the Ru surface, the growth rate will be inhibited by adsorption of additives such as a suppressor and/or leveler on the copper. As a result the current density for the nucleation and growth peak in the i-U curve for Ru is much lower in the solution with additives than in the solution without additives. After the formation of about 50 nm of copper (determined by integration of the charge under the copper nucleation and growth peak), the current-voltage curve for Ru coincides with that of Cu. From the current-voltage curves in FIG. 6 it is concluded that the addition of a suppressing additive to the plating solution is necessary to obtained favored plating on the liner material, even when the potential of copper is more negative than the neighboring liner as a result of the terminal effect.

For exemplary purposes only, the above disclosure illustrates copper plating on tungsten based liners for ULSI applications. However, the concept of seedless electroplating can be extended to the plating of any metal, alloy, compound, composite or semiconductor on a highly resistive substrate. The high resistance of the substrate may be due to the thickness of the substrate film (high sheet resistance) or simply due to the nature of the substrate (material with a high resistivity).

The thickness of the plated metal is typically about 0.02 to about 25 microns, more typically about 0.1 to about 2 microns and preferably about 0.3 to about 1 microns.

Examples of platable high resistive metal barrier layer are tantalum, tantalum nitride, titanium, titanium nitride, tungsten, tungsten nitride, ruthenium, rhenium, cobalt, molybdenum, chromium, mixtures thereof and alloys thereof. Further examples of platable high resistive metal barrier layers are iridium, platinum, gold, thallium, lead, bismuth, vanadium, chromium, cobalt, iron, nickel, copper, aluminum, silicon, carbon, germanium, gallium, arsenic, selenium, rubidium, strontium, yttrium, zirconium, niobium, rhodium, palladium, silver, cadmium, tin, antimony, tellurium, hafnium and osmium. The alloys of the above metals can include various alloying materials such as, but not limited to O, S, N, B and P. Also the barrier layer can comprise a plurality of layers of the same and/or different compositions.

The foregoing description of the invention illustrates and describes the present invention. Additionally, the disclosure shows and describes only the preferred embodiments of the invention but, as mentioned above, it is to be understood that the invention is capable of use in various other combinations, modifications, and environments and is capable of changes or modifications within the scope of the invention concept as expressed herein, commensurate with the above teachings and/or the skill or knowledge of the relevant art. The embodiments described hereinabove are further intended to explain best modes known of practicing the invention and to enable others skilled in the art to utilize the invention in such, or other, embodiments and with the various modifications required by the particular applications or uses of the invention. Accordingly, the description is not intended to limit the invention to the form disclosed herein. Also, it is intended that the appended claims be construed to include alternative embodiments.

What is claimed is:

1. A method for electroplating an electrically conductive material onto a platable resistive metal barrier layer(s) located on a substrate which comprises:

contacting the substrate with a plating bath that optionally comprises a super filling additive and supressor, applying a current or voltage across electrodes, wherein the substrates acts as one electrode and a conductor acts as a counter electrode to plate the electrically conductive material on the substrate;

changing the current that is applied across the electrodes from an initially small or zero value to a final, higher value corresponding to a desired current density for the total plated area, or changing the voltage that is applied across the electrodes from an initial small or zero value corresponding to an open-circuit potential or a small overpotential to a final larger voltage corresponding to a larger overpotential for deposition thereby plating said electrically conductive material from the edge of the substrate towards its center, and wherein said method is carried out in the absence of a copper seed layer on the barrier layer.

2. The method of claim 1 wherein said current is changed through a current program selected from the group consisting of a series of current steps (positive and/or negative), a linear current ramp (positive and/or negative), a nonlinear current ramp (positive and/or negative) and combinations thereof.

3. The method of claim 1 wherein said voltage is changed through a voltage program selected from the group consisting of a series of voltage steps (positive and/or negative), a linear voltage ramp (positive and/or negative), a nonlinear voltage ramp (positive and/or negative) and combinations thereof.

4. The method of claim 1 wherein the current density during the plating deviates from the desired current density by at most about 100%.

5. The method of claim 1 wherein the current density during the plating deviates from the desired current density by at most about 50%.

6. The method of claim 1 wherein the current density during the plating deviates from the desired current density by at most about 25%.

7. The method of claim 1 wherein the current density during the plating deviates from the desired current density by at most about 10%.

8. The method of claim 1 wherein said conductive material comprises copper.

9. The method of claim 1 wherein said resistive metal is selected from the group consisting of tantalum, tantalum nitride, titanium, titanium nitride, tungsten, tungsten nitride, ruthenium, rhenium, cobalt, molybdenum, chromium, indium, platinum, gold, thallium lead, bismuth, vanadium, chromium, cobalt, iron, nickel, copper, aluminum, silicon, carbon, germanium, gallium, arsenic, selenium, rubidium, strontium, yttrium, zirconium, niobium, rhodium, palladium, silver, cadmium, tin, antimony, tellerium, hafnium and osmium, mixtures thereof and alloys thereof.

10. The method of claim 1 wherein said resistive metal is selected from the group consisting of tantalum, tantalum nitride, titanium, titanium nitride, tungsten, tungsten nitride, ruthenium, rhenium, cobalt, molybdenum, chromium, mixtures thereof and alloys thereof.

11. The method of claim 1 wherein the current or voltage is changed by linear ramping.

12. The method of claim 1 wherein the current or voltage is changed by a non-linear function ramp.

13. The method of claim 1 wherein the current or voltage is changed step-wise.

14. The method of claim 2 wherein the current is changed by a combination of current programs.

15. The method of claim 3 wherein the voltage is changed by a combination of voltage programs.

16. The method of claim 1 wherein the current density is about 10 $\mu A/cm^2$ to about 100 $mA/cm^2$.

17. The process of claim 1 wherein the plating bath comprises a copper salt, and a mineral acid, and optionally containing one or more additives selected from the group consisting of an organic sulfur compound with water solubilizing groups, a bath-soluble oxygen-containing compound, a bath-soluble polyether compound, or a bath-soluble organic nitrogen compound that may also contain at least one sulfur atom.

18. A plated structure obtained by the process of claim 1.

19. The plated structure of claim 18 wherein the conductive material comprises copper.

20. The plated structure of claim 18 wherein the higher resistive metal is selected from the group consisting of tantalum, tantalum nitride, titanium, titanium nitride, tungsten, tungsten nitride, ruthenium, rhenium, cobalt, molybdenum, chromium, mixtures thereof and alloys thereof.

21. The method of claim 1 wherein a layer of about 10 nanometers to about 100 micrometers of said conductive material is coated onto said barrier layer.

22. The method of claim 1 wherein said current is continuously increased to said final, higher value.

23. The method of claim 1 wherein said current is incrementally increased to said final, higher value.

* * * * *